US009211753B2

(12) United States Patent
Faber

(10) Patent No.: US 9,211,753 B2
(45) Date of Patent: Dec. 15, 2015

(54) ELECTRONIC PRINTING DEVICE IN THE FORM OF A HAND STAMP

(71) Applicant: COLOP Stempelerzeugung Skopek Gesellschaft m.b.H & Co. KG., Wels (AT)

(72) Inventor: Ernst Faber, Wels (AT)

(73) Assignee: COLOP Stempelerzeugung Skopek Gesellschaft m.b.H. & Co. KG., Wels (AU)

( * ) Notice: Subject to any disclaimer, the term of this patent is extended or adjusted under 35 U.S.C. 154(b) by 0 days.

(21) Appl. No.: 14/433,129

(22) PCT Filed: Sep. 26, 2013

(86) PCT No.: PCT/AT2013/050196
§ 371 (c)(1),
(2) Date: Apr. 2, 2015

(87) PCT Pub. No.: WO2014/063177
PCT Pub. Date: May 1, 2014

(65) Prior Publication Data

US 2015/0258831 A1 Sep. 17, 2015

(30) Foreign Application Priority Data

Oct. 23, 2012 (AT) ..... A 50468/2012

(51) Int. Cl.
*B41K 1/00* (2006.01)
*B41K 1/38* (2006.01)
(Continued)

(52) U.S. Cl.
CPC ..... *B41K 1/38* (2013.01); *B41J 2/1752* (2013.01); *B41J 2/17526* (2013.01); *B41J 3/28* (2013.01); *B41J 3/36* (2013.01); *B41K 1/00* (2013.01)

(58) Field of Classification Search
CPC .... B41J 2/1752; B41J 2/17526; B41J 2/1753; B41J 25/34; B41J 3/36; B41J 3/28; B41K 1/00; B41K 1/40
See application file for complete search history.

(56) References Cited

U.S. PATENT DOCUMENTS 5,880,448 A 3/1999 Hetzer et al.
6,502,917 B1 * 1/2003 Shinada et al. ..... 347/19
(Continued)

FOREIGN PATENT DOCUMENTS

DE 195 22 595 A1 1/1997
DE 10 2005 014 227 B4 10/2006
(Continued)

OTHER PUBLICATIONS

International Search Report of PCT/AT2013/050196, mailed Dec. 20, 2013.
(Continued)

*Primary Examiner* — Blake A Tankersley
(74) *Attorney, Agent, or Firm* — Collard & Roe, P.C.

(57) ABSTRACT

An electronic printing device in the form of a hand stamp includes a housing in which a solid-state electronic printing assembly cartridge is removably inserted. Electric contacts, which are arranged on one face of the cartridge, for supplying power to and controlling the cartridge rest against corresponding electric contacts in the housing under the influence of pressure when the cartridge is inserted in the housing in the operating state. For this purpose, a spring device for holding the cartridge against the housing contacts is arranged in the housing on the cartridge face opposite the face with the electric contacts, and the spring device is a leaf spring which is arranged on a drive part face facing the cartridge when the cartridge is inserted in the operating state and which is angled outward and directly presses against the cartridge, the drive part being movably arranged in the housing. A movable wedge, which is provided in order to adjust the drive part, interacts with an upper surface of the drive part.

10 Claims, 2 Drawing Sheets

(51) Int. Cl.

| | |
|---|---|
| ***B41J 2/175*** | (2006.01) |
| ***B41J 3/28*** | (2006.01) |
| ***B41J 3/36*** | (2006.01) |

(56) References Cited

U.S. PATENT DOCUMENTS

| | | | | |
|---|---|---|---|---|
| 7,270,410 | B2 * | 9/2007 | Silverbrook | 347/109 |
| 2002/0135634 | A1 | 9/2002 | Lodal et al. | |
| 2003/0214557 | A1 * | 11/2003 | Nakamura et al. | 347/49 |
| 2007/0120937 | A1 | 5/2007 | Ahne et al. | |
| 2008/0198215 | A1 | 8/2008 | Nopper et al. | |
| 2009/0278902 | A1 | 11/2009 | Iwata et al. | |
| 2010/0128072 | A1 | 5/2010 | Wagner | |

FOREIGN PATENT DOCUMENTS

| | | | |
|---|---|---|---|
| EP | 0 598 251 | A1 | 5/1994 |
| EP | 2 192 556 | A1 | 6/2010 |
| JP | 2005-335230 | A | 12/2005 |
| WO | 02/02343 | A1 | 1/2002 |
| WO | 03/068513 | A1 | 8/2003 |
| WO | 03/068520 | A1 | 8/2003 |

OTHER PUBLICATIONS

Austrian Office Action in A 50468/2012-1, dated Mar. 22, 2013, with English translation of relevant parts.

* cited by examiner

FIG. 1
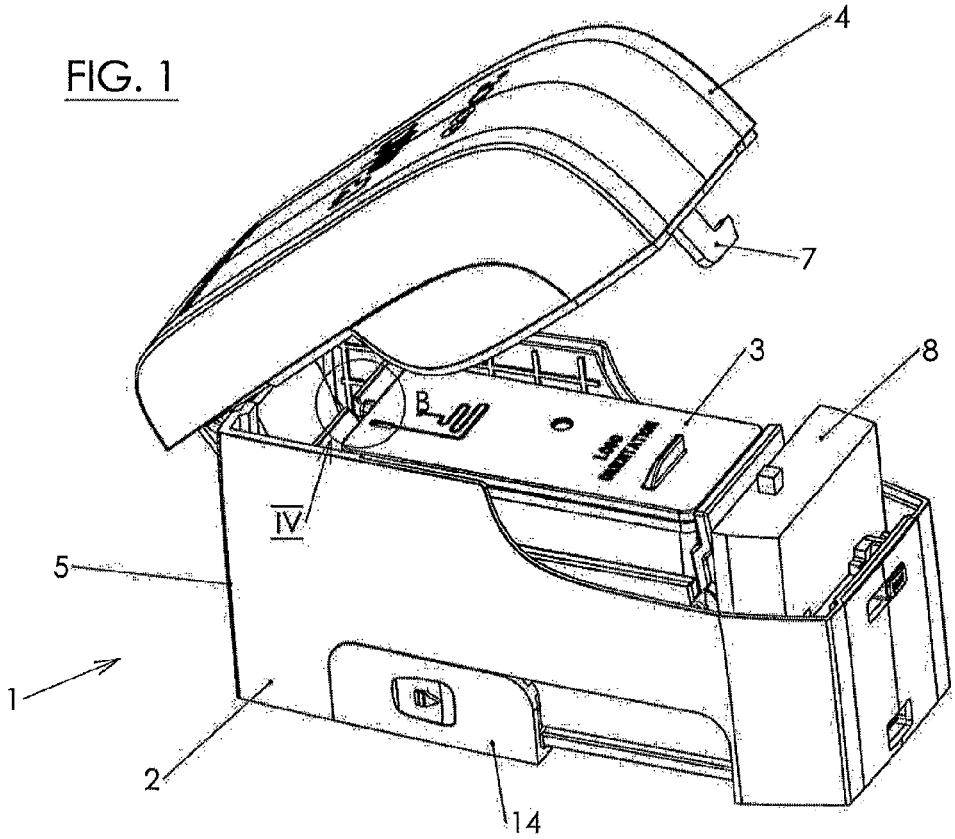
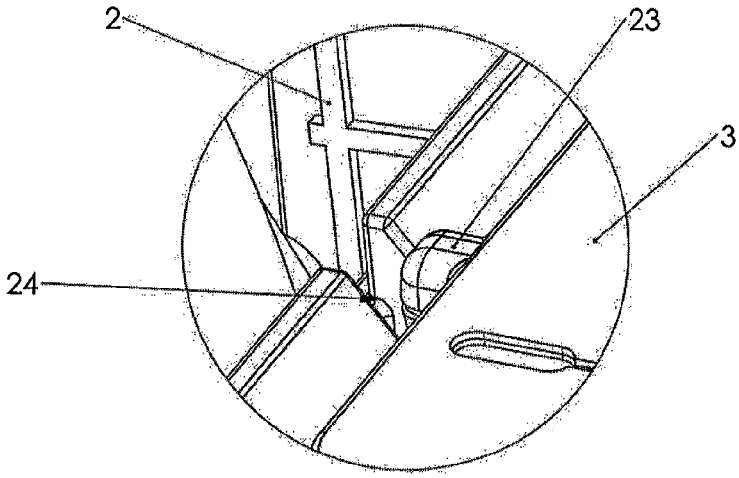
FIG. 4

ELECTRONIC PRINTING DEVICE IN THE FORM OF A HAND STAMP

CROSS REFERENCE TO RELATED APPLICATIONS

This application is the National Stage of PCT/AT2013/050196 filed on Sep. 26, 2013, which claims priority under 35 U.S.C. §119 of Austrian Application No. A 50468/2012 filed on Oct. 23, 2012, the disclosure of which is incorporated by reference. The international application under PCT article 21(2) was not published in English.

FIELD OF THE INVENTION

The invention relates to an electronic printing device in the form of a hand stamp, including a housing in which a compact electronic printing unit cartridge is removably inserted or insertable in the operating position, wherein, in the operating position of the cartridge inserted in the housing, electric contacts arranged on one side of the cartridge for supplying power to and controlling the cartridge rest under pressure against associated electric contacts in the housing, and for this purpose a spring device for holding the cartridge against the housing contacts is arranged in the housing on the side of the cartridge opposite the side with the electric contacts.

BACKGROUND OF THE INVENTION

The use of an electronic printing aggregate, or a print unit or a printer head, respectively, frequently also called "cartridge", in a hand stamp has become an ever increasing concern of hand stamp manufacturers in recent times. On the one hand, there have been approaches to movably attach the respective printer head, or cartridge, in a housing so as to produce, as a print on a substrate, in particular a sheet of paper, an image that is large relative to the printer head. In this case, the printer head may, in particular, be an ink jet printer head, yet optionally also a wire matrix printer or a thermal printer head. Such a stamp-like printer is, for instance, disclosed in EP 598 251 A1. On the other hand, there have been proposals to attach the printer head, or the printing unit cartridge, firmly in a housing and manually move the printing device during printing, cf. e.g. DE 10 2005 014 227 B4, which describes an electronic printing device of this type. There, printing data electronically stored in a memory are supplied to the printer head in the housing. An electric connection of the printing cartridge, in particular the ink jet printer head, to the memory provided in the housing of the device, is thus required in addition to the general power supply, in particular via a suitable activation.

From US 2007/0120937 A1, a similar printing device is known, which is manually moved over a base to produce prints on the same. There, a thermal printer is, for instance, mentioned as printer. That thermal printer, or generally the printing unit cartridge, is held in its position by the aid of an additional swing cover provided below the pivotable housing cover proper. Said additional swing cover comprises a plate-shaped projection on its underside, which, in the closed state of the additional swing cover, projects between a spring device firmly arranged in the housing and the printer head cartridge, thus increasing and equalizing the pressure exerted by the spring on the cartridge. That structure results from the printing device commercially available under the name of "design runner" according to the aforementioned US 2007/0120937 A1. It involves the disadvantage of the spring pressing against the printing unit cartridge even when the additional swing cover is opened, thus causing the housing-fixed contacts and the cartridge contacts to rub against each other on the opposite side, both when inserting the cartridge and when removing the same.

From JP 2005-335230 A, an ink jet printer is known, in which a replaceable print cartridge is pressed against housing contacts by the aid of a torsion spring and an angle lever. With a cartridge inserted, one arm of the torsion spring presses onto the cartridge from above, and another spring arm presses an arm of the angle lever against the cartridge.

US 2002/0135634 A1 discloses a printer comprising printer heads that are adjustable along a rail transversely to a paper to be printed; each of the printer heads contains a print cartridge, which is pressed into a contact position by a lever mechanism and a helical compression spring engaging the former.

Another table printer including a carriage that is movable along a rail and accommodates a print cartridge is known from US 2009/0278902 A1. An upper cover and a locking lever are provided for fixing the print cartridge in the carriage.

SUMMARY OF THE INVENTION

It is an object of the invention, in a printing device as initially defined, to press the printing unit cartridge, in the following briefly referred to as cartridge, in the operating position against the housing-fixed electric contacts in such a manner as to obtain a safe electric connection and power supply, on the one hand, and to prevent the respective contacts from sliding against each other, so as to become worn during the insertion or removal of the cartridge, on the other hand.

To solve this object, the invention provides an electronic printing device as defined in the beginning, which is, moreover, characterized in that the spring device is an angled leaf spring arranged on a drive part movably arranged in the housing, on its side facing the cartridge in the inserted, operating state, and directly pressing against the cartridge; and that a movable wedge provided for adjusting the drive part interacts with an upper surface of the drive part.

In the present electronic printing device, electric contacts arranged on one side of the cartridge for supplying power to, and controlling, the cartridge in the operating position of the cartridge inserted in the housing thus rest under pressure against associated electric contacts in the housing; in order to achieve such abutment under pressure, a spring device comprised of a leaf spring is arranged in the housing on the side of the cartridge opposite the side with the electric contacts for holding the cartridge against the housing contacts. Said leaf spring is arranged on a drive part movably arranged in the housing. Such a configuration allows for careful handling of the individual contacts, which are simply formed by conductor surfaces, e.g. copper-plated areas on printed circuit boards, with corresponding contact surfaces of the cartridge contacting the contact surfaces of a circuit board fixedly arranged in the housing, during the insertion and removal of the cartridge. This is ensured in that, for inserting or removing the cartridge, the drive part, on which the leaf spring is arranged, is shifted away from the housing-fixed contacts so as to provide sufficient space for the insertion or removal of the cartridge. In the inserted state of the cartridge, the drive part is then moved towards the cartridge, at least partially, in order to exert an appropriate pressure on the cartridge in the direction of the electric contacts via the leaf spring arranged on it. When removing the cartridge, the drive part is moved back from the cartridge during or after opening of the housing such that also the leaf spring will be moved away from the cartridge, thus leaving the cartridge "pressure-free" in the housing and thereby allowing its removal from the housing without causing a rubbing effect between the contacts. By the leaf spring pressing directly against the cartridge, a soft application of the cartridge is enabled.

For displacing the drive part, a movable wedge is provided, which interacts with an upper surface, e.g. oblique surface, of the drive part. Said wedge is moved from a lifted resting position into an operating position, in which it presses the drive part in the direction against the housing-fixed contacts. This will be achieved in a particularly simple manner in terms of construction, if the wedge is attached to a housing cover associated to the housing and interacts with the drive part during closing of the housing cover in order to displace the former. The housing cover, which carries the wedge, can be pivotally hinged to the housing in a simple and captive manner. Theoretically, it is, however, also conceivable for the housing cover to be removable from the housing and capable of being placed on, and fixed to, the housing together with the wedge, e.g. by snapping on.

In order to ensure a favorable application of force to the cartridge, it will be of particular advantage if the drive part is comprised of a rocker pivotally mounted in the housing. With such a configuration, the rocker is pivoted into the operating position by the wedge in order to press the leaf spring, and hence the cartridge, in the direction of the housing-fixed contacts by the pivotal movement of the rocker. In order to ensure the optimum application of force, it will be beneficial if the rocker is approximately in the middle of its height extension, pivotally mounted in the housing. The angled leaf spring can be fixed to the rocker, for instance in the upper region thereof, by a plane portion and protrude from the rocker in the direction of the cartridge by a lower portion, pressing the cartridge towards the contacts by its protruding portion. Here the location where the spring rests against the cartridge may advantageously be on level with the contacts.

In order to ensure the exact orientation of the respective contacts on the cartridge, or in the housing, in the operating position, it will also be advantageous if a centering projection is arranged on the cartridge on its side comprising the electric contacts, which centering projection in the inserted, operating state of the cartridge engages a guiding recess provided in the housing.

BRIEF DESCRIPTION OF THE DRAWINGS

In the following, the invention will be explained in even more detail by way of particularly preferred exemplary embodiments, to which is, however, not to be restricted. In the drawings:

FIG. 1 is a schematic elevational illustration of an electronic printing device including a cartridge within a housing, wherein also a centering projection of the cartridge is illustrated, which engages a corresponding guiding recess in the housing for positioning the cartridge;

FIG. 4, on an enlarged scale, illustrates the detail IV of FIG. 3 to show the centering projection in connection with the associated guiding recess.

DETAILED DESCRIPTION OF THE DRAWINGS

Figure 3:
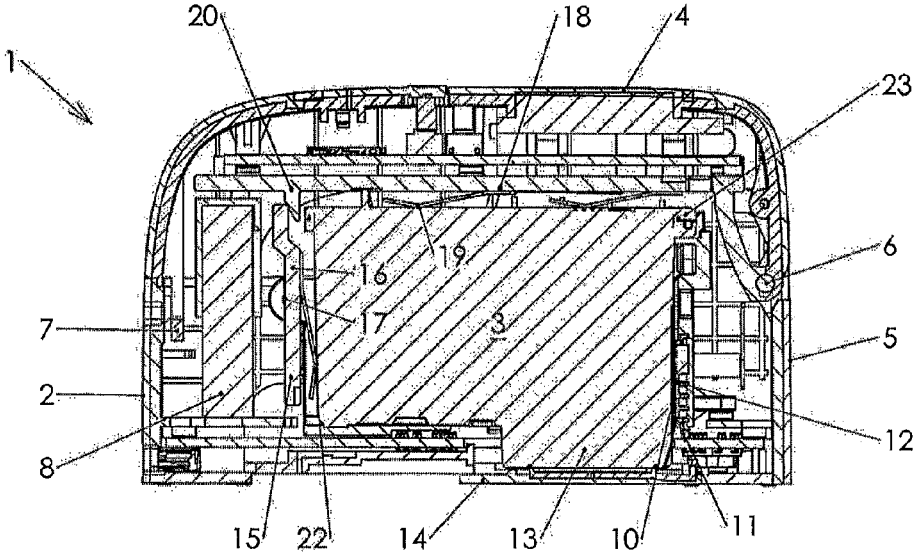
FIG. 3 depicts a corresponding longitudinal section through said printing device with the housing cover closed.
Figure 2:
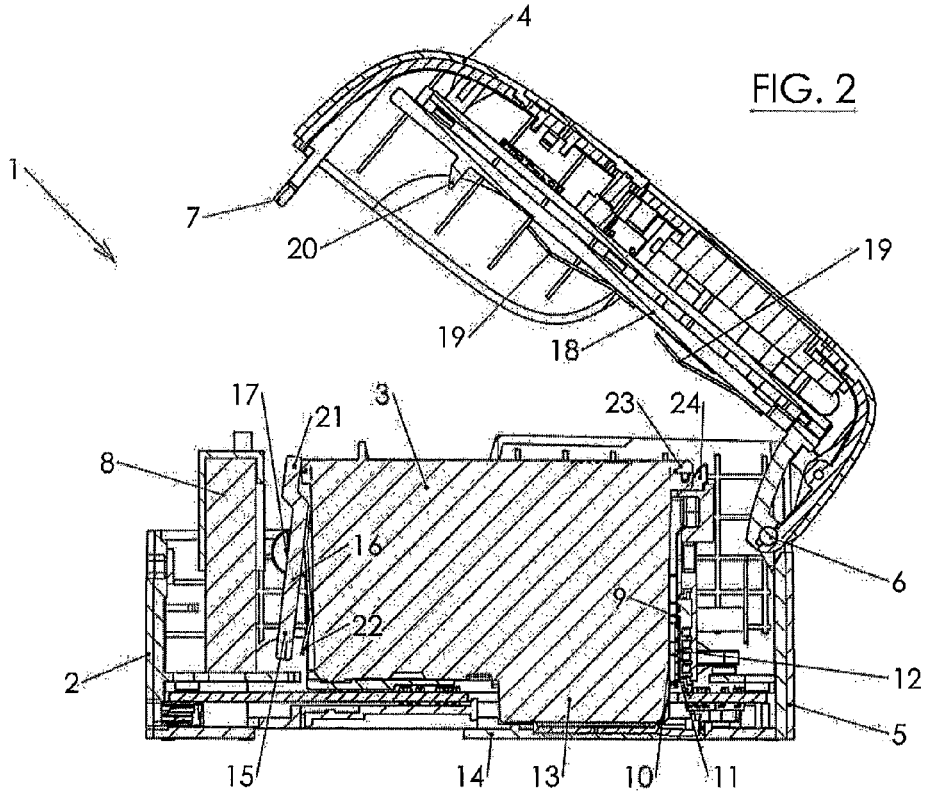
FIG. 2 illustrates a schematic longitudinal section through such an electronic printing device in the form of a hand stamp, with the printing unit cartridge inserted and the device cover opened.

FIGS. 1 to 3 are elevational schematic illustrations of an electronic printing device 1 in the form of a hand stamp, comprising a housing 2 in whose interior a printing unit cartridge 3 is inserted. The housing 2 is open on its upper side, yet can be closed by a housing cover 4 for activating the printing device 1. The housing cover 4 as such might be simply attachable to or snappable onto the top of the housing 2, yet in the exemplary embodiment shown it is configured as a hinged cover 4 which is articulately connected by a joint via a pivot axis 6 on one of its two narrow sides, i.e. the narrow side 5 shown on the left-hand side of FIG. 1 and illustrated on the right-hand side in FIGS. 2 and 3. The hinged housing cover 4 is shown in an opened position in FIGS. 1 and 2, whereas it covers the housing 2 on top in the position according to FIG. 3. When closing the housing cover 4, a hook 7 engages the housing cover 4 behind a holder (not illustrated) in the interior of the housing 2.

A rechargeable electric accumulator or battery 8 is further provided in the interior of the housing 2 and can be removed from the interior of the housing 2 in a manner similar to the cartridge 3, e.g. for replacement or maintenance purposes.

The printing unit cartridge 3, in the following briefly referred to as cartridge 3, can, for instance, comprise an ink jet printing unit (not illustrated), and it is electronically controlled and supplied with information relating to the respective print image or cliche to be printed in a manner not to be described in detail. What is just interesting here is that, on the one hand, electric contacts 10 in the form of contact surfaces, e.g. copper surfaces, are provided on a face of the cartridge 3, i.e. on the right-hand face 9 according to FIGS. 2 and 3, which are to be electrically "connected" to corresponding electric contacts 11 provided in the housing 2, for instance on a printed circuit board 12. In the closed position of the printing device 1 according to FIG. 3, the contacts 10, 11 are brought into mutual abutment under pressure for the purpose of good contacting, as will be discussed in more detail below, whereas in the opened position according to FIG. 2 (and FIG. 1), no pressure is exerted on the cartridge 3, the cartridge 3 thus being slightly moved to the left and away from the contacts 11 fixedly arranged in the housing 2 according to the illustrations of FIGS. 2 and 3.

Before explaining the means used to apply such an elastic pressure, it should be noted for the sake of completeness that the housing 2 comprises an opening on its underside, which opening is not illustrated in the drawings, and through which the printing part 13 proper of the cartridge 3 passes when in the operating position or printing position a slide 14 provided on the underside of the housing 2 is moved from the closed position shown in FIGS. 1 to 3 into an open position, i.e. to the left according to the illustrations of FIGS. 2 and 3, or to the right according to the illustration of FIG. 1. The configuration of the printing unit cartridge 3 and its printing part 13 proper, e.g. in the form of an ink jet printer, can be of a type conventional per se and will not be explained in detail herein.

In the housing 2, a drive part 15 is arranged adjacent the accumulator or battery 8 on the side facing the cartridge 3 so as to be displaceable in the housing 2, cf. FIGS. 2 and 3. Said drive part 15 is actually designed as a rocker 16 mounted in the interior of the housing 2 so as to be pivotable about an axis 17 in its center.

On the inner or underside of the housing cover 4 is further arranged, for instance, a pressure plate 18 to whose inner or underside leaf springs 19 are attached, which press against the upper side of the cartridge 3 in the closed position according to FIG. 3, thus fixing the cartridge 3 vertically within the housing 2. The pressure plate 18, moreover, carries a wedge 20 on its under or inner side, which wedge interacts with an upper-side and optionally chamfered (FIG. 2) surface 21 of the drive part 15 when closing the printing device 1, i.e. the device cover 4, so as to cause pivoting of the rocker 16 about the axis 17 in a counter-clockwise direction as illustrated in FIGS. 2 and 3; during such pivoting, a leaf spring 22 fastened to the rocker 16 comes into firm resilient abutment on the side of the cartridge 3 located opposite the contacts 10, 11, by its angled region cantilevering freely downwards from an upper end fixed to the rocker 16. This situation is illustrated in FIG. 3, wherein a good contact between the contact surfaces 10, 11 is ensured by such resilient abutment on the cartridge 3, of the leaf spring 22 attached to the rocker 16 or, generally speaking, to the drive part 15. However, as the swing cover 4 of the housing is opened, the cartridge 3, which is slightly shifted to the left according to the illustration of FIG. 2 relative to that of FIG. 3, presses the drive part 15 away, i.e. it pivots the rocker 16 clockwisely into the slanted position depicted in FIG. 2, whereby the pressure contact between contacts 10 and 11 will be terminated. In the opened position shown in FIG. 2 and also in FIG. 1, the cartridge 3 can be upwardly removed from the interior of the housing 2 without any problem, i.e. without scratching the contact surfaces of the contacts 10 and 11, respectively.

When closing the device cover 4, the rocker 16 is pivoted by the wedge 20 in the counter-clockwise direction as already mentioned in order to firmly press the leaf spring 22 against the cartridge 3. In doing so, the cartridge 3 is shifted to the right according to the illustrations of FIGS. 2 and 3, and to the left according to that of FIG. 1. During such shifting movement, a centering projection 23 enters a guiding recess 24 of the housing 2, cf., in particular, FIG. 4 in addition to FIGS. 2 and 1. This causes the cartridge 3 to be positioned exactly horizontally within the housing 2 in the closing position to avoid misalignment between contacts 10, 11.

Although the invention has been explained in detail above by way of particularly advantageous exemplary embodiments, alterations and modifications are possible within the scope of the invention. Thus, it is, for instance, conceivable to configure the drive part 15 as a component horizontally displaceable in guides rather than as a pivotable rocker 16. In the case of a rocker 16, the upper part may also be simply designed to extend obliquely rather than being cranked as shown in FIGS. 2 and 3. Moreover, the pressure unit 3/13 can be configured as a dot matrix printer rather than an ink jet printer. Finally, the slide 14 may simply be omitted such that the printing unit 13 of the cartridge 3 will always be ready for use on the underside of the housing 2. For the protection of the printing unit 13, a cover slide 14 as apparent from FIGS. 1 to 3 is, however, recommended.

As is apparent from FIG. 1, the rocker 16 (or, in general, the drive part 15) has a width at least approximately equal to the width of the cartridge 3, and in a corresponding manner also the leaf spring 22 may have such a width—or a slightly smaller width. It is, however, also conceivable to attach several—e.g. two or three—such leaf springs 22 side by side to the rocker 16 (or the drive 15).

The invention claimed is:

1. An electronic printing device (1) in the form of a hand stamp, including: a housing (2); and a compact electronic printing unit cartridge (3), the compact electronic printing unit cartridge (3) being removably inserted or insertable into the housing in an operating position, wherein, in the operating position of the cartridge (3) inserted in the housing (2), electric contacts (10) arranged on one side of the cartridge (3) for supplying power to and controlling the cartridge (3) rest under pressure against associated electric contacts (11) in the housing (2), and for this purpose a spring device for holding the cartridge (3) against the housing contacts (11) is arranged in the housing (2) on the side of the cartridge (3) opposite the side with the electric contacts (10, 11), wherein the spring device is an angled leaf spring (22) arranged on a drive part (15) which is movably arranged in the housing (2), on the side of the drive part facing the cartridge (3) in the inserted, operating state, and directly pressing against the cartridge (3); and wherein a movable wedge (20) provided for adjusting the drive part (15) interacts with an upper surface (21) of the drive part (15).

2. A printing device according to claim 1, wherein the wedge (20) is attached to a housing cover (4) associated to the housing (2) and interacts with the drive part (15) during closing of the housing cover (4) for displacing the former.

3. A printing device according to claim 2, wherein the housing cover (4) is pivotally hinged to the housing (2).

4. A printing device according to claim 3, wherein a centering projection (23) is arranged on the cartridge (3) on its side comprising the electric contacts (10), which centering projection in the inserted, operating state of the cartridge (3) engages a guiding recess (24) provided in the housing (2).

5. A printing device according to claim 2, wherein a centering projection (23) is arranged on the cartridge (3) on its side comprising the electric contacts (10), which centering projection in the inserted, operating state of the cartridge (3) engages a guiding recess (24) provided in the housing (2).

6. A printing device according to claim 1, wherein the drive part (15) comprises a rocker (16) pivotally mounted in the housing (2).

7. A printing device according to claim 6, wherein the rocker (16) is approximately in the middle of its height extension, pivotally mounted in the housing (2).

8. A printing device according to claim 7, wherein a centering projection (23) is arranged on the cartridge (3) on its side comprising the electric contacts (10), which centering projection in the inserted, operating state of the cartridge (3) engages a guiding recess (24) provided in the housing (2).

9. A printing device according to claim 6, wherein a centering projection (23) is arranged on the cartridge (3) on its side comprising the electric contacts (10), which centering projection in the inserted, operating state of the cartridge (3) engages a guiding recess (24) provided in the housing (2).

10. A printing device according to claim 1, wherein a centering projection (23) is arranged on the cartridge (3) on its side comprising the electric contacts (10), which centering projection in the inserted, operating state of the cartridge (3) engages a guiding recess (24) provided in the housing (2).

* * * * *